United States Patent [19]

Welter

[11] 4,454,223

[45] Jun. 12, 1984

[54] ORGANIC OXIDANTS AND RADICAL TRAPS FOR NEGATIVE-WORKING SILVER HALIDE EMULSIONS

[75] Inventor: James J. Welter, Asheville, N.C.

[73] Assignee: E. I. Du Pont de Nemours and Company, Wilmington, Del.

[21] Appl. No.: 408,493

[22] Filed: Aug. 16, 1982

[51] Int. Cl.[3] ..... G03C 1/34

[52] U.S. Cl. ..... 430/533; 430/966; 430/607; 430/599; 430/569; 430/611; 430/606

[58] Field of Search ..... 430/607, 611, 613, 569, 430/564, 599, 966, 600, 603, 533, 606

[56] References Cited

U.S. PATENT DOCUMENTS 4,323,645 4/1982 Hall et al. ..... 430/607

FOREIGN PATENT DOCUMENTS 623448 5/1949 United Kingdom ..... 430/607

*Primary Examiner*—Won H. Louie, Jr.

[57] ABSTRACT

Small amounts of radical traps resorcylaldehyde oxime and 2,2-diphenyl-1-picrylhydrazyl and organic oxidants 2-chloro-5-nitrobenzylchloride, p-nitro-o-chlorobenzyl thiosulfate and 2-(p-nitrobenzyl)thiopyridinium bromide reduce the fog and stabilize the aging of medical X-ray emulsion with little or no effect on speed.

5 Claims, No Drawings

ORGANIC OXIDANTS AND RADICAL TRAPS FOR NEGATIVE-WORKING SILVER HALIDE EMULSIONS

TECHNICAL FIELD

This invention is in the field of photography, and more particularly relates to negative-working silver halide emulsions characterized by reduced fog and improved aging stability.

BACKGROUND OF THE INVENTION

A wide variety of organic and inorganic compounds are used for the complex series of steps by which a negative-working silver halide emulsion of high sensitivity is produced. One such step involves the chemical sensitization of the silver halide grains to increase their light sensitivity.

During chemical sensitization, the individual grains of a negative silver halide emulsion undergo a localized surface reaction to produce sensitivity specks which are believed to consist of silver, gold, silver sulfide or some combination thereof.

Between the time of adding the sensitizer and coating the liquid emulsion on a support, the emulsion is usually given a heat treatment, called digestion. During digestion a reaction is believed to occur which produces sensitivity sites on the surface of the silver halide grains. Unfortunately, as the digestion reaction is continued in order to obtain a higher level of sensitivity, some silver halide grains become spontaneously developable without exposure. This causes the emulsion to fog. Films made with grains which have undergone digestion to achive high sensitivity not only exhibit this fog when tested shortly after being coated, but display higher levels of fog as the film is aged. This may reach a level such that the film is unusable and in any case limits the useful life of the film. Undesirable losses in sensitivity may also accompany the increase in fog as the film ages.

Efforts to obtain higher sensitivity for negative-working silver halide emulsions must in some fashion deal with the problem. One practical method of doing this is to tolerate some acceptable fog level in commercial photographic emulsions. Another is to add antifoggant or stabilizer compounds to reduce fresh fog and/or to prevent the formation of aging fog while accepting some sacrifice of sensitivity as a tradeoff for the improvement.

The present invention attacks the fog problem encountered in negative-working silver halide emulsions by providing a group of organic oxidants and radical traps which are selectively effective in eliminating fresh fog from highly sensitized emulsions, and in preventing formation of fog on aging.

SUMMARY OF THE INVENTION

In accordance with this invention, a negative-working silver halide emulsion of improved speed-to-fog ratio and lower aging fog (superior aging stability) is produced by the incorporation therein of either (1) one or more organic oxidants selected from the following: 2-chloro-5-nitrobenzyl chloride, p-nitrobenzyl o-chloro thiosulfate, and 2-(p-nitrobenzyl)thio-pyridinium bromide and (2) radical traps selected from resorcylaldehyde oxime and 2,2-diphenyl-1-picrylhydrazyl. Organic oxidants and radical traps are effective when added to the emulsion in amounts of from 1 to 1000 mg/mole of silver halide at the completion of the chemical sensitization. These orgranic oxidants and radical traps need only a very short holding time in the liquid emulsion to lower the fresh and aging fog, without adversely affecting speed, gradation, and top density of the coated films. These compounds may be used in combination with known antifoggants to reduce the fog of medical X-ray emulsion with little or no speed loss while also improving aging stability. This new technology offers an opportunity to develop products with superior diagnostic clarity, use alternate sensitization techniques which would otherwise give high fog, or trade off all or part of these advantages for lower silver coating weight. While more than 50 compounds were tested, the compounds listed above are the only ones found to be effective.

DETAILED DESCRIPTION OF THE INVENTION

In general, the compounds useful for the present invention may be characterized as oxidizing agents or radical traps which appear to selectively react with the fog sites on the silver halide grains. It is possible to obtain the benefits of the present invention by simply mixing the compounds with the emulsion just prior to coating.

In the field of electron paramagnetic resonance the compound 2,2-diphenyl-1-picrylhydrazyl

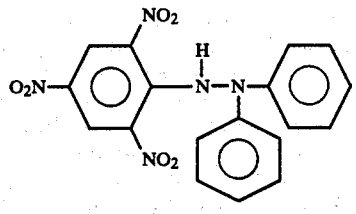

is used as a standard. This compound gives a standard resonance signal in the absence of other compounds. It is preferred to as "a free radical in a bottle".

On the other hand resorcylaldehyde oxime

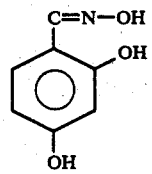

represents a free radical source only after reacting with the solvent to which it is added. However, from a practical point of view a free radical source is available once solutions have been prepared of either of these two compounds.

While the mechanism may not be the same, both organic oxidants and free radial traps can convert silver metal to silver ion. An orgranic oxidant can react directly; a free radical trap most probably must first complex at the silver site and then remove the electron from silver to the trapped free radial. In either event, it is believed that the reaction is selective enough that the largest sensitivity specks undergo conversion to form smaller specks. The net result is that fog is lower both in fresh and aging tests and the sensitometric properties are more stable as the film is aged.

The present invention is operative with silver halide grains produced by single jet, splash, and double jet precipitation techniques, to yield heterodisperse and monodisperse grain size distributions. Into the grains made by such known techniques metal ions may be introduced to modify the photographic response, and nonmetallic compounds may be added to increase sensitivity or restrain fog. In some cases it may be desirable to wash grains which have been chemically modified, and to then further increase the size of the grains by precipitating a layer of silver halide over the original grains. The term "coreshell" grain has come to apply to such layered grains.

The silver halide constituent of the negative-working silver halide emulsions described herein may consist of pure or mixed silver chloride, bromide, or iodide, and the grains may be regular or irregular in shape, e.g., cubic, octahedral, rhombohedral, etc.

As a binder agent and peptizing media for these emulsions it is normal to employ gelatin. However, gelatin may be partially or wholly replaced by other natural or synthetic protective colloids known in the art.

Other useful additives include ortho- and panchromatic sensitizing dyes; speed-increasing compounds such as polyalkylene glycols; surface active agents which are useful as coating aids; antifoggants; and stabilizers, including indazoles, imidazoles, azaindenes, heavy metal compounds such as mercury salts, and polyhydroxy benzene compounds.

Other useful ingredients for these negative-working elements include hardeners, antistatic agents, matting agents, plasticizers, brighteners, and natural and synthetic wetting agents. All these ingredients may be combined to yield formulations capable of being coated on suitable supports such as cellulose nitrate film, cellulose ester film, poly(vinyl acetal) film, polystyrene film, poly(ethylene terephthalate) film, and related films, as well as glass, paper, metal and the like.

The invention is illustrated by the following Examples.

EXAMPLE 1

A high speed negative silver iodobromide emulsion was gold-sulfur sensitized and stabilized with after-additions of 4-hydroxy-6-methyl-1,3,3a,7-tetraazaindene and 1-phenyl-5-mercaptotetrazole as well known in the art. A portion of this emulsion without further addition served as a control. Other portions of this emulsion received additions of radical traps as shown in Table 1 and organic oxidants as shown in Table 2. The control and experiments were coated on a poly(ethylene terephthalate) support and overcoated with a protective gelatin layer. After drying, samples were tested fresh, others were conditioned for one week at 49° C. under 65% relative humidity before testing. Fresh and aged samples were given both 0.2 and 4 second 70 KVP X-ray exposures through a step wedge and developed at 33° C. for 19 sec. in Cronex ®XMD continuous tone developer (hydroquinone-phenidone). Overdeveloped fog was tested by developing unexposed samples at 39° C. for 19 sec. Results of these tests are summarized in the following Tables.

TABLE 1

| CP. # | Compound Added | Amount mg/1.5 mole AgBr | Rel. Speed | Fog |
|---|---|---|---|---|
| | None (Control) | — | 100 | .09 |

TABLE 1-continued

| CP. # | Compound Added | Amount mg/1.5 mole AgBr | Rel. Speed | Fog |
|---|---|---|---|---|
| 1 | 2,2-diphenyl-1-picryhydrazyl | 50 | 94 | .07 |
| 2 | Resorcylaldehyde oxime | 500 | 96 | .07 |
| 3 | 1-hydroxyl-2,2,-6,6 tetramethyl piperidine | 50 | 100 | .12 |

As indicated compounds 1 and 2 are effective while compound 3 only contributes to higher fog.

The structures of the compounds tested are:

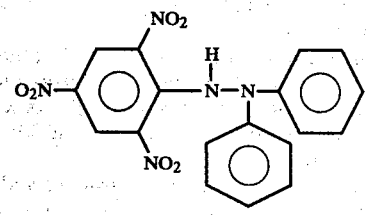

1

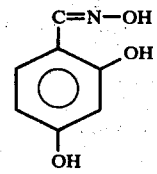

2

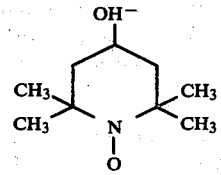

TABLE 2

| CP. # | Compound Added | mg/1.5 mole AGBr Amount | Speed | Fog | O.D. Fog |
|---|---|---|---|---|---|
| | None (Control) | — | 100 | .20 | .50 |
| 4 | p-nitro-o-chloro-benzyl thio-sulfate | 160 | 109 | .18 | .48 |
| 4 | p-nitro-o-chloro-benzyl thio-sulfate | 240 | 106 | .16 | .48 |
| 4 | p-nitro-o-chloro-benzyl thio-sulfate | 320 | 96 | .14 | .32 |
| 4 | p-nitro-o-chloro-benzyl thio-sulfate | 400 | 93 | .10 | .26 |
| 5 | p-nitrobenzyl-thiosulfate | 160 | 97 | .22 | .61 |
| 5 | p-nitrobenzyl-thiosulfate | 240 | 100 | .22 | .47 |
| 5 | p-nitrobenzyl-thiosulfate | 320 | 108 | .25 | .45 |
| 5 | p-nitrobenzyl-thiosulfate | 400 | 86 | .23 | .46 |

While compound 4 and 5 have similar structures, only compound 4 was found to be effective.

The structure of the compounds tested are:

4.

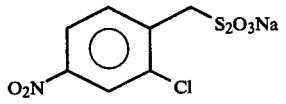

5.

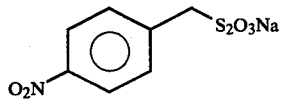

EXAMPLE 2

Experiments and controls were run similar to Example 1 with a variety of compounds in the category of organic oxidants and radical traps. Tests at one month normal aging determined that an advantage seen in fresh testing was maintained as the film sample was held under identical conditions with its control.

Table 3 contains a listing and structure of compounds which were almost as effective as compounds 1, 2, and 4 in Example 1. Table 4 lists compounds which were tested and found to be ineffective, along with a reason for the ineffective result.

TABLE 3

| | |
|---|---|
| 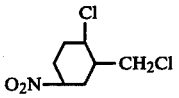  | 2-chloro-5-nitrobenzyl chloride |
| 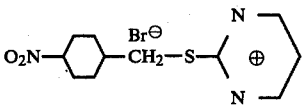  | 2-(p-nitrobenzyl)thio-pyridinium bromide |

TABLE 4

| Compound | Reason Ineffective |
|---|---|
| 2-nitro-5-nitrobenzyl-chloride | No effect |
| 1,4,7,8 tetra-methyl-1,10-phenanthrazine | Desensitization |
| 3-chloroaniline | Desensitization |
| p-nitrobenzyl thiocyanate | No effect |
| p-nitro(α-methyl) benzyl thiocyanate | No effect |
| 2-(p-nitrobenzyl) thio-pyridinium bromide | Desensitization |

I claim:

1. A negative-working silver halide emulsion having low fog and improved aging stability, characterized in that said emulsion includes an organic compound selected from the group consisting of:

(1) 2,2-diphenyl-1-picrylhydrazyl (2) p-nitro-o-chlorobenzylthiosulfate

2. The emulsion of claim 1 wherein said organic compound is present in a concentration of 1-1000 mg/mole of silver halide.

3. The emulsion of claim 1 wherein the silver halide is AgIBr.

4. A medical X-ray film comprising a polyester film support coated with the negative-working silver halide emulsion of claim 1.

5. A process for the production of a medical X-ray film containing a negative-working silver halide emulsion which consists essentially of the steps of:

(1) preparing a silver halide precipitate in a colloid binder;

(2) sensitizing the resultant emulsion;

(3) adding to the sensitized emulsion an organic compound selected from the group recited in claim 1 and (4) coating the emulsion upon a support.

* * * * *